US006211824B1

(12) United States Patent
Holden et al.

(10) Patent No.: US 6,211,824 B1
(45) Date of Patent: Apr. 3, 2001

(54) MICROSTRIP PATCH ANTENNA

(75) Inventors: Richard H. Holden, Maynard; Joseph A. Preiss, Westford; Gennaro Ledonne, Quincy, all of MA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/305,968

(22) Filed: May 6, 1999

(51) Int. Cl.[7] ..... H01Q 1/38
(52) U.S. Cl. ..... 343/700 MS; 343/846
(58) Field of Search ..... 343/700 MS, 846, 343/829, 830, 831, 848; H01Q 1/38

(56) References Cited

U.S. PATENT DOCUMENTS 5,227,749 * 7/1993 Raguenet et al. ..... 343/700 MS
5,400,040 3/1995 Lane et al. ..... 343/700
5,434,581 * 7/1995 Raguenet et al. ..... 343/700 MS
5,539,420 * 7/1996 Dusseux et al. ..... 343/700 MS
5,745,079 * 4/1998 Wang et al. ..... 343/700 MS
5,841,401 11/1998 Bodley et al. ..... 343/700
5,880,694 * 3/1999 Wang et al. ..... 343/700 MS

* cited by examiner

*Primary Examiner*—Hoanganh Le
(74) *Attorney, Agent, or Firm*—Foley, Hoag & Eliot LLP

(57) ABSTRACT

An integrated directional patch antenna uses multiple patch radiating elements to control the direction of a beam of radio frequency energy (RF) over a large scan volume. The antenna includes a ground plane element and a first dielectric planar member placed on a major surface of the ground plane element. A plurality of first patch radiator elements is arranged on a surface of the first dielectric member remote from the ground plane element. A second dielectric planar member is placed on first patch radiator elements, and a plurality of second patch radiator elements arranged on a surface of the second dielectric member remote from the first patch radiator elements. First regions are formed in the dielectric planar member that have a first dielectric constant and are separated from each other by second regions that have a dielectric constant different from the first dielectric constant to effectively prevent surface wave energy from propagating in the first dielectric planar member, thereby increasing the scan volume of the antenna.

14 Claims, 10 Drawing Sheets

| DIELECTRIC CONSTANT OF DIELECTRIC SHEET 16 | MAXIMUM SCAN ANGLE (DISCONTINUITIES IN SHEET 16 ACCORDING TO THE INVENTION) | MAXIMUM SCAN ANGLE (CONTINUOUS SHEET 16) |
|---|---|---|
| 2.0 | 83.7° | 69.9° |
| 3.0 | 83.7° | 60.5° |
| 4.0 | 83.7° | 52.3° |
| 5.0 | 83.7° | 44.4° |
| 6.0 | 83.7° | 36.7° |

Fig. 10

MICROSTRIP PATCH ANTENNA

BACKGROUND OF THE INVENTION

1. Field of the invention

This application relates to the field of patch antennas and more particularly to the field of directional patch antennas using multiple patch radiating elements to control the direction of a beam of radio frequency energy (RF) over a large scan volume.

2. Description of Related Art

Many applications, such as scanning Radar and communication with satellites in a low orbit, require that the orientation of an RF beam emitted in three-dimensional space be adjusted rapidly with respect to a stationary reference axis without physically moving the antenna. This can be implemented using a stationary array of antenna elements which are coupled to an RF signal source and can be individually controlled. The spatial orientation of the RF beam can be changed by adjusting the relative phase of the RF signal supplied to the antenna elements. An antenna of this type is generally referred to as an "electronically scanned array", a "phased array" or a "patch" antenna and is described, for example, in the commonly assigned U.S. Pat. No. 5,400,040 "Microstrip Patch Antenna" to J. P. Lane et al., which is incorporated herein by reference.

The array antenna can either be assembled from individual antenna elements, or radiators, that are mounted on a passive support structure to form an array. The radiators represent individual waveguide cavities that terminate in a waveguide aperture; the waveguide apertures are typically co-planar with a ground plane. This approach minimizes the number of elements required for a desired array aperture and scan volume and maximizes scan volume coverage. On the other hand, the radiating aperture does not utilize the entire surface area of a "unit cell" since the area on the support structure located between the waveguide apertures is taken up by the ground plane, limiting the bandwidth of the device. Such antennas are also expensive to manufacture since each antenna element has to be inserted separately in the support structure.

Other known patch antennas are configured as a stacked patch, with each antenna element including a feed patch coupled to an RF signal source and a coupled patch separated from the feed patch by a dielectric layer, as illustrated in FIG. 1. Patch antennas of this type can be produced inexpensively by conventional integrated circuit manufacturing techniques, e.g., photolithography, on a continuous dielectric substrate. They have excellent frequency bandwidth since the radiating aperture is essentially the entire unit cell. Scan volume performance, however, is impaired due to the excitation of electromagnetic surface waves in the dielectric substrate. Surface wave excitation is especially severe when the dielectric constant of the substrate material is high, e.g., with advanced ceramic materials such as Low-Temperature Co-fired Ceramics (LTCC). It is therefore desirable to improve the antenna performance by eliminating or at least reducing the excitation of surface waves within the dielectric substrate.

SUMMARY OF THE INVENTION

In one aspect of the invention, a patch radiator antenna includes a dielectric substrate having a first and second surface and a plurality of spaced apart first patch radiator elements arranged upon the first surface of the dielectric substrate. Each of the first patch radiator elements defines a patch area and can be electrically coupled to an RF signal source or an RF receiver. Areas with different dielectric constants are defined in the dielectric substrate, wherein a region in the dielectric substrate that substantially overlaps with a patch area has a first dielectric constant and another region in the dielectric substrate that does not overlap with a patch area has a second dielectric constant. This arrangement prevents propagation of surface wave energy in the dielectric substrate between the first patch radiator elements.

According to another aspect of the invention, a patch radiator antenna includes a ground plane element and a first dielectric planar member placed on a major surface of the ground plane element. A plurality of first patch radiator elements is arranged on a surface of the first dielectric member remote from the ground plane element. A second dielectric planar member is placed on first patch radiator elements, and a plurality of second patch radiator elements arranged on a surface of the second dielectric member remote from the first patch radiator elements, with each second patch radiator element associated with a corresponding first patch radiator element. The first dielectric planar member includes areas having a first dielectric constant being separated from areas having a second dielectric constant that is different from the first dielectric constant to effectively prevent surface wave energy from propagating in the first dielectric planar member between the first patch elements.

The integrated patch antenna of the invention provides both a large scan volume and a large bandwidth even with substrate materials having a high dielectric constant. Surface waves which would otherwise limit the bandwidth, are essentially eliminated.

Embodiments of the invention may include one or more of the following features.

At least a portion of the first region may overlap with the patch area. The regions with the first dielectric constant may be the substrate and/or may be made of a metal. The second region may include a plurality of spaced apart openings arranged in the dielectric substrate substantially in a region that overlaps the outer perimeter of the patch area. The openings may extend either partially or completely from one of the first and second surface of the dielectric substrate to the opposite surface of the dielectric substrate and may have the form of, for example, holes and/or slots. The inside surface of the openings may be metallized and/or the openings may be filled with a metal or another material having a dielectric constant with a value that is different from that of the material surrounding the opening. The first patch radiator elements may be placed on a separate support sheet.

The patch radiator elements may have a substantially circular or a polygonal, e.g., rectangular shape. The lateral spacing between adjacent patch radiator elements may be approximately one half of the radiated free space wavelength. The value of the dielectric constant of the dielectric substrate may be selected to lie between approximately 1.5 and 8; the dielectric substrate may be made of a Low-Temperature Co-fired Ceramics (LTCC) with a dielectric constant of between 5 and 7. The value of the dielectric constant of the second dielectric sheet may be selected to lie between approximately 1.0 and 2.5.

The first patch radiator element may be coupled to an RF signal source via a one or more coupling location to effect the polarization of the emitted RF beam. The first patch radiator element may also be coupled to the RF signal source via a waveguide.

Further features and advantages of the present invention will be apparent from the following description of preferred embodiments and from the claims. In the drawings, elements having identical features or performing identical functions are given the same reference numerals.

BRIEF DESCRIPTION OF THE DRAWINGS

FIG. 10 shows a comparison between the maximum scan angles attainable with the patch radiator array according to the invention and those of a conventional patch radiator array.

DETAILED DESCRIPTION OF THE PREFERRED EMBODIMENT(S)

Figure 1:
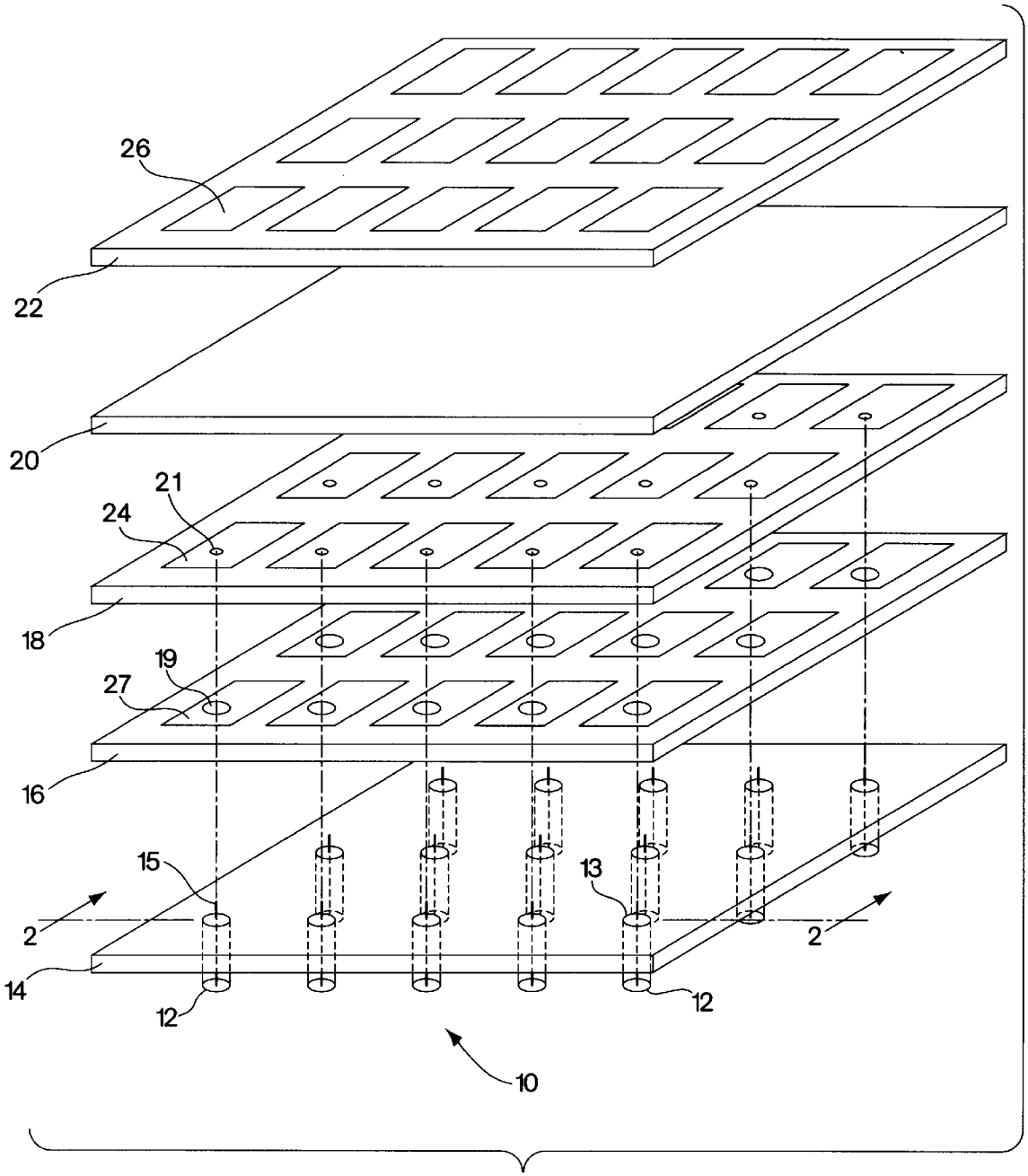
FIG. 1 is an exploded perspective view of a patch radiator array according to the invention.

In the drawings, identical elements or elements performing an identical function are indicated with the same reference numerals.

Figure 2:
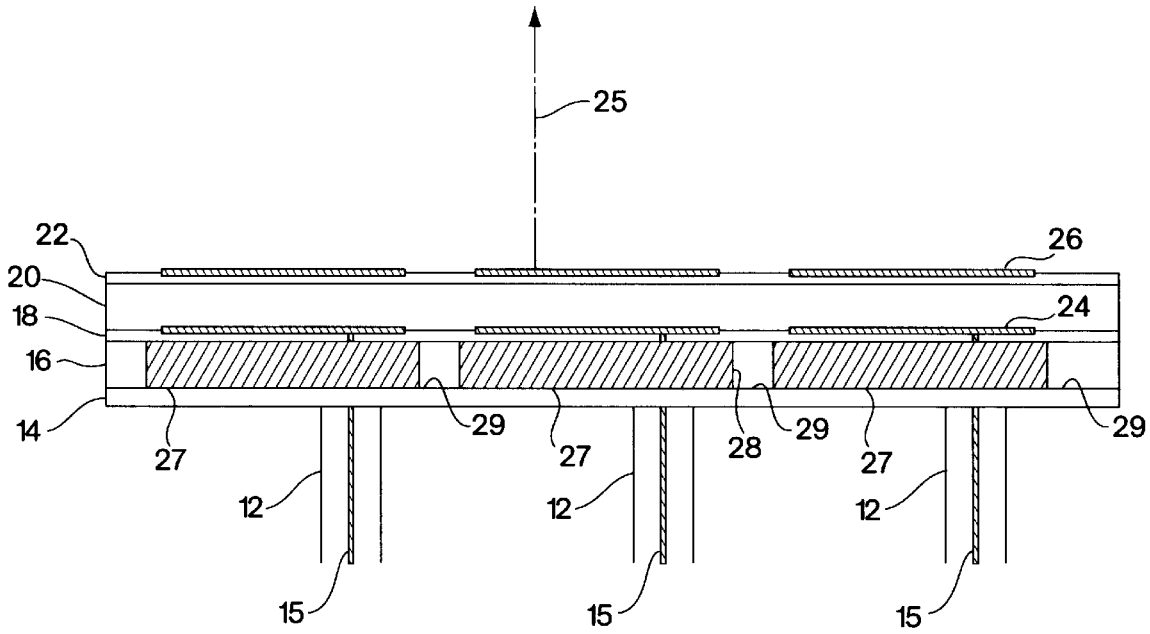
FIG. 2 is a cross-sectional view of a first embodiment of the dielectric layer of the invention taken along the line II—II of FIG. 1.

Referring first to FIGS. 1 and 2, a patch antenna 10 includes a ground plane 14 provided with openings 13 to receive coaxial feed lines 12 having a center conductor 15. The ground plane 14 may be either a solid metallic plate made, e.g., of copper, or a metallized dielectric plate. Disposed on the ground plate 14 is a first dielectric sheet 16 and an arrangement of first patch elements 24 which may be disposed on a support sheet 18. Generally, a patch element can be a relatively thin metal or other material having metallic properties, emitting at a wavelength of greater than approximately 0.01 cm and less than approximately 20 cm. In one embodiment, the patch element 24 can comprise a metallic member having a thickness of about 25 micrometer emitting at a wavelength of approximately 3 cm. The patch elements 24 are typically arranged in a regular geometrical pattern, e.g., a rectangular or close-packed pattern. Each patch element 24 is coupled to a corresponding center conductor 15 at a connection point 21. Alternatively, as will be discussed later, RF signal power may also be supplied to the patch elements 24 through waveguides, e.g., strip waveguides. The connection point 21 is typically offset from the geometric center of the patch element to enable efficient radiation of the RF power, as known from antenna theory. Other desired radiation patterns, e.g., a linearly or circularly polarized beam can be produced with different coupling locations and methods known in the art.

The first dielectric sheet 16 provides termination for the feed lines 12 and may include openings 19 to accommodate the center conductors 15.

Although the patch antenna can operate with only the ground plane 14, the dielectric sheet 16 and the patch radiator elements 24, the frequency bandwidth of the patch antenna array can advantageously be increased by incorporating respective second patch elements 26 associated with each of the first patch radiator elements 24. As seen in FIG. 2, the second patch element 26 is spaced apart from the first patch radiator element 24 by a second dielectric sheet 20. The second patch element 26 may be arranged on a separate support sheet 22, as illustrated in FIG. 1, or may be deposited directly on the second dielectric sheet 20. The second dielectric layer 20 has preferably a relatively low dielectric constant in the range of between approximately 1 and 2.

Referring back to FIG. 2, the dielectric sheets 16, 20 form dielectric waveguides in the direction parallel to the major surfaces of the sheets 16, 20. A larger dielectric constant of the dielectric layer causes the dielectric waves in the dielectric sheets 16, 20 to be more strongly confined to the respective sheets. Consequently, waveguiding is particularly severe in layer 16, since the dielectric constant of that layer must typically has a value, which is significantly larger than 1, to provide proper termination of the feed lines 12. Values in the range of 6–8 are not uncommon, in particular when the layer is made of a machinable ceramics, such as LTCC. The strong waveguiding effect implies that a significant fraction of the RF signal energy which is coupled into the dielectric layer 16 by the first patch antenna elements 24, may become confined to the dielectric layer 16 in the form of guided waves and therefore does not contribute to the radiated RF beam power. Conversely, the dielectric constant of dielectric layer 20 is typically much smaller, between approximately 1 and 3, making waveguiding effects less of an issue.

The guided waves propagating in dielectric layer 16 tend to reduce the scan volume of the antenna array. This can be understood from FIG. 2 by considering the component of the radiated RF beam power parallel to the major surface of waveguide 16. When the RF beam axis forms a larger angle with the surface normal, indicated by arrow 25, an increasing fraction of the RF signal power is coupled into the waveguide 16. Consequently, a lesser fraction of the supplied RF signal power is available for radiation into the free space, thereby limiting the scan volume. A reduction or preferably, a complete elimination of the guided waves in the dielectric waveguide 16 will therefore increase the scan volume of the patch antenna array 10.

It is a realization of the present invention that guided waves can be prevented from propagating in the dielectric sheet 16 by interrupting the dielectric continuity of sheet 16 between adjacent first patch radiator elements 24. The dielectric continuity can be interrupted in several ways, as will now be discussed.

In one embodiment of the invention, as shown also in FIG. 2, regions 27 having substantially the same shape and size as the first patch radiator elements 24 are formed in the dielectric sheet 16. These regions 27 have a dielectric constant which is different from and preferably greater than that of the remaining area of the sheet 16. Those skilled in the art will appreciate that the dielectric constant is frequency-dependent and that the materials of which the regions 27 and the remaining area of the sheet 16 is formed, may be insulators, metals and/or semiconductors. In a preferred embodiment, the area of the sheet 16 is a metal. A dielectric surface wave generated in regions 27 will then be reflected at the dielectric discontinuity 28 between regions 27 and the remaining sheet area.

The regions 27 may be implemented, e.g., by physically removing areas that correspond to the regions 27 from the sheet 16, such as a metallic sheet, and replacing the removed areas with "plugs" having a suitable shape, e.g., circles or polygons, and made of a material with a different dielectric constant. Alternatively, regions 27 may be created by altering the dielectric constant of corresponding areas of the sheet 16 from that of the surrounding material by chemical processes, such as diffusion of chemical species, or by ion implantation.

Figure 3:
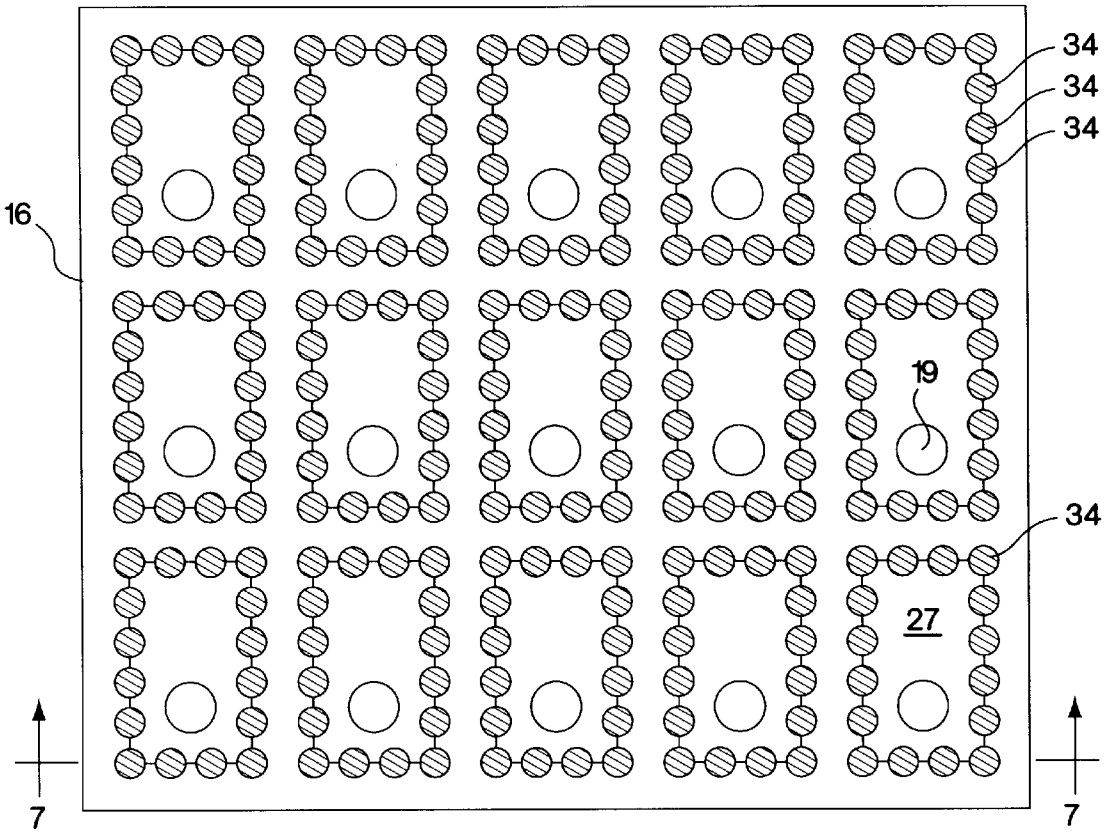
FIG. 3 is a top plan view of a second embodiment of the dielectric layer of the invention of FIG. 1.
Figure 4:
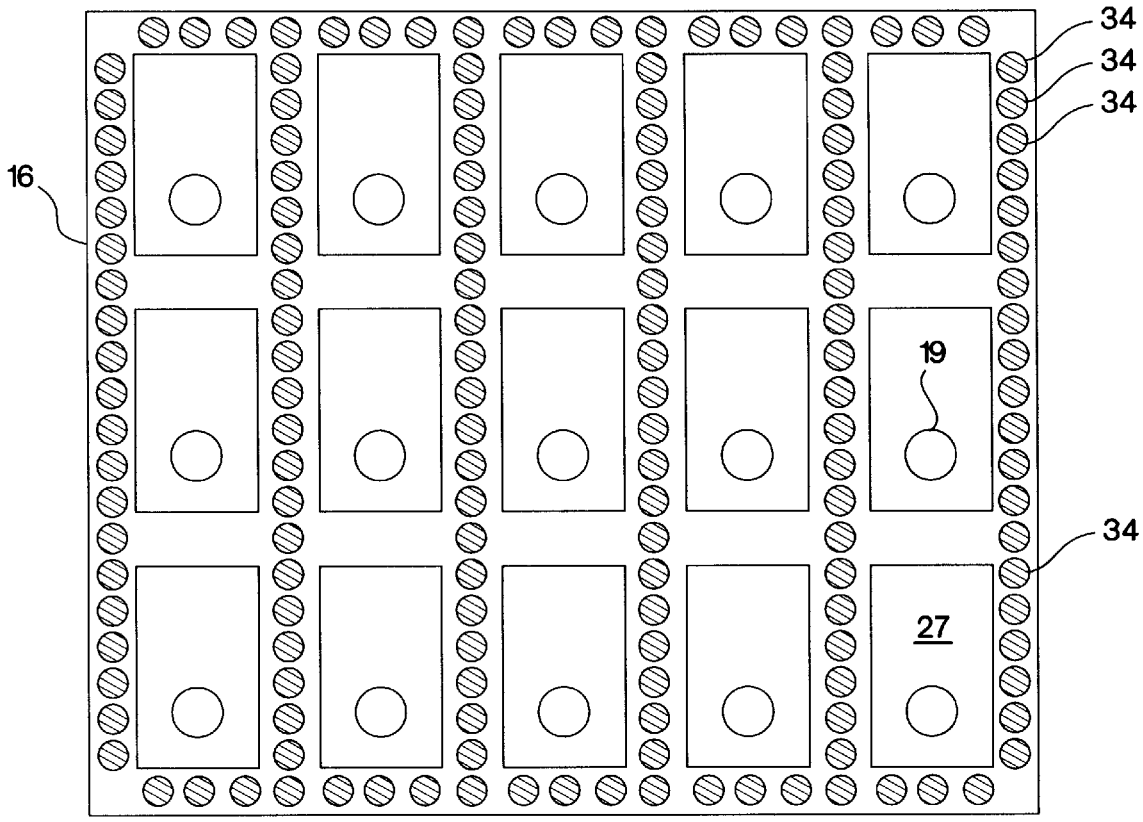
FIG. 4 is a top plan view of a third embodiment of the dielectric layer of the invention of FIG. 1.

Referring now to FIGS. 3 and 4, according to another embodiment of the invention, the regions 27 of dielectric sheet 16 are delineated from the rest of the sheet 16 by placing openings 34 in the form of circular holes or recesses between the regions 27. The openings may either encircle each region separately, as indicated in the example shown in FIG. 3, or a common row and/or column of openings may be shared by two adjacent regions 27, as indicated in FIG. 4. The embodiment of FIG. 4 may be preferred where the spacing between adjacent regions 27 is significantly less than the linear dimensions of the regions 27.

Figure 5:
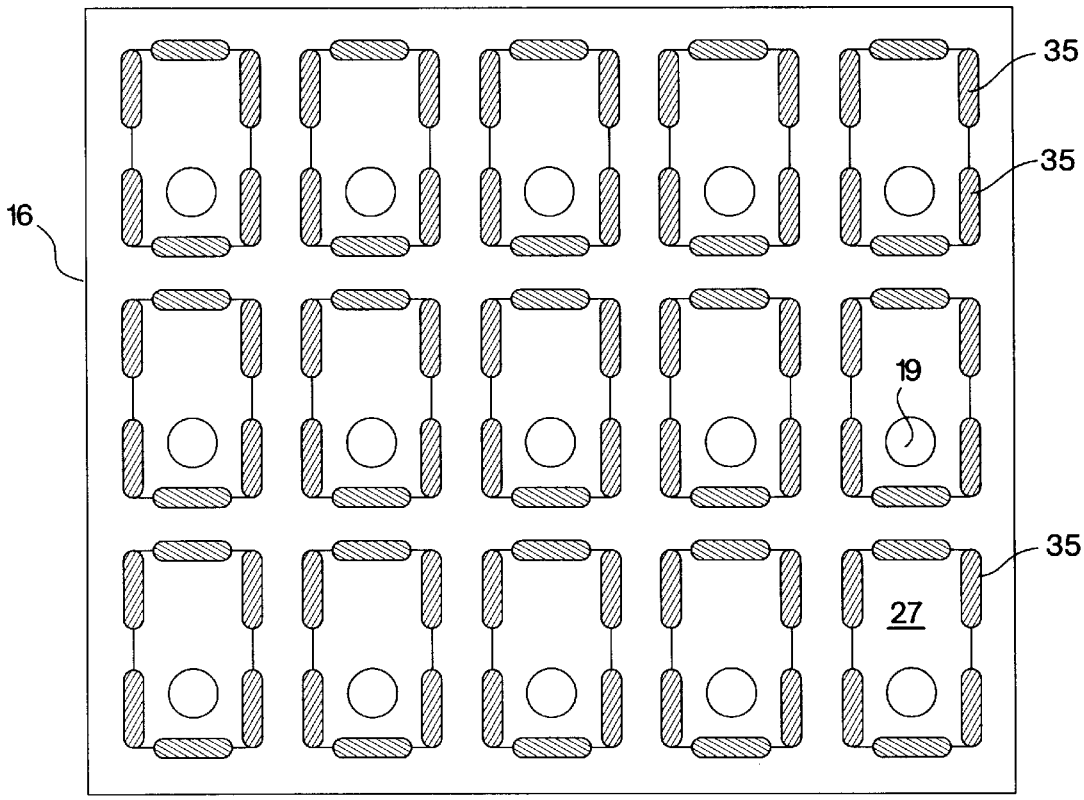
FIG. 5 is a top plan view of a fourth embodiment of the dielectric layer of the invention of FIG. 1.
Figure 6:
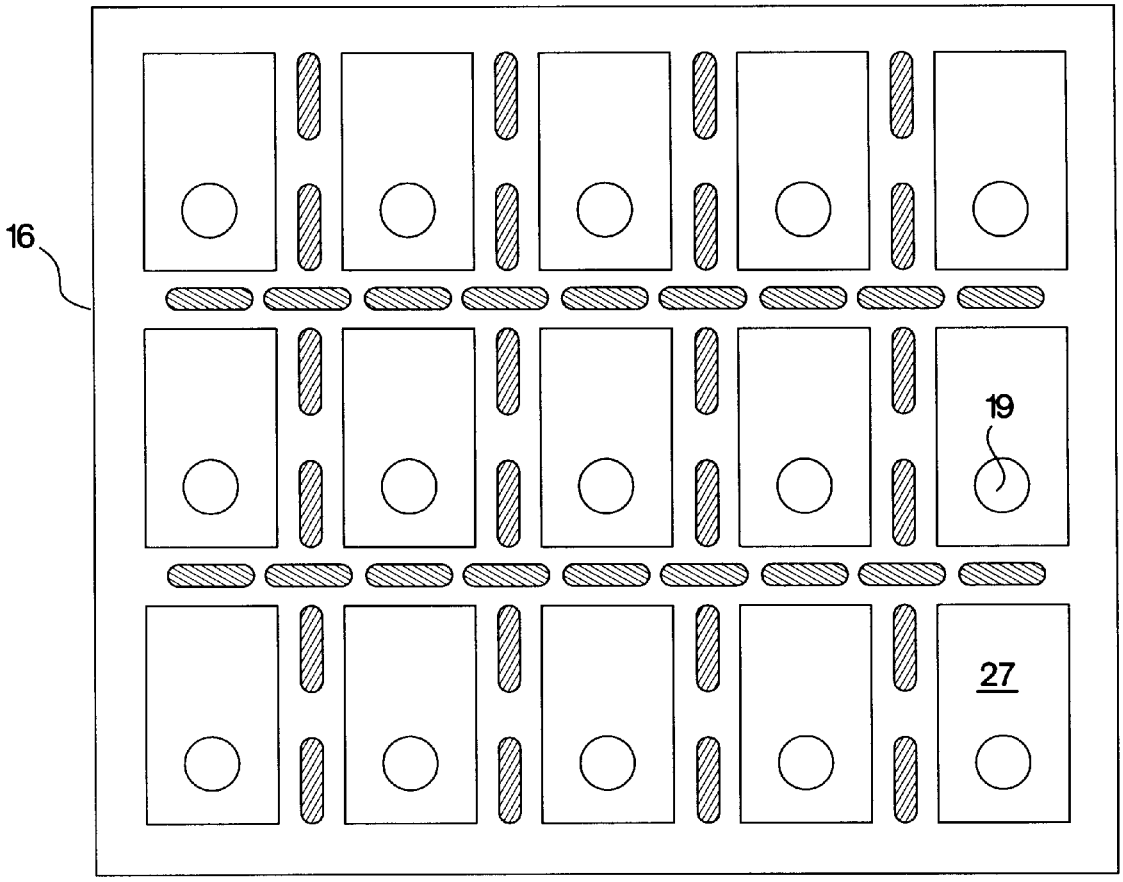
FIG. 6 is a top plan view of a fifth embodiment of the dielectric layer of the invention of FIG. 1.

The dielectric constant of the material inside region 27 can be identical to that of the rest of sheet 16. The openings may have other shapes, such the slots of the embodiment shown in FIGS. 5 and 6. In this embodiment, as in the embodiment of FIGS. 3 and 3, the slots may be disposed separately around each region 27 or shared by two adjacent regions 27. The holes and slots may be omitted along the marginal edges of the antenna array, as shown in FIG. 6.

The inside surface of the holes or slots may be metallized or filled with a bulk metal, e.g., a soldering compound and the like. The openings may also be filled with a dielectric material having a dielectric constant different from that of the surrounding material.

Figure 7A:
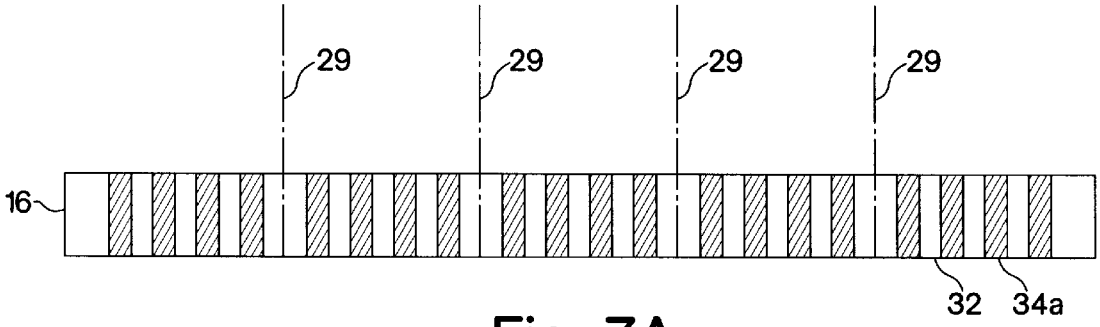
FIGS. 7A–7C show a cross-sectional view of embodiments of the dielectric layer taken along the line V—V of FIG. 3.
Figure 7B:
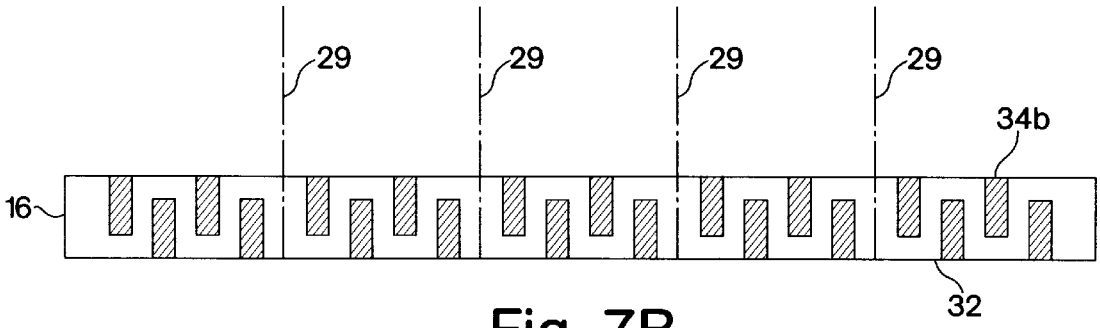
Figure 7C:
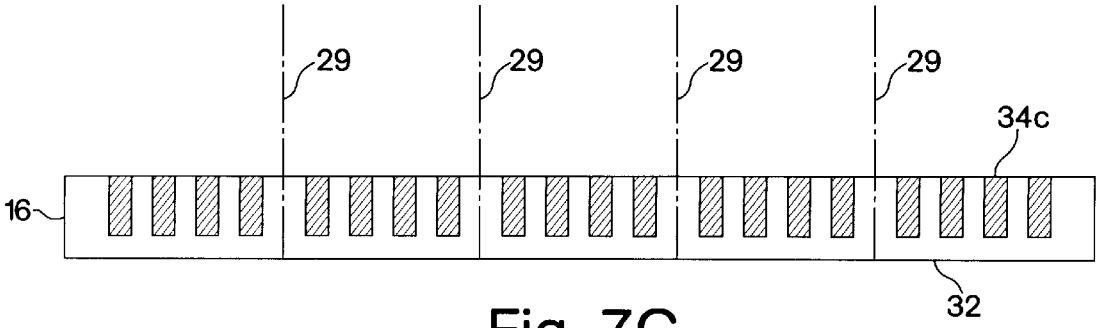

Referring now to FIGS. 7A–7C, a cross-sectional view along the line V—V of FIG. 3 illustrates various embodiments for arranging the openings 34 in sheet 16. The openings 34 can be in the form of through holes 34*a* (FIG. 7A) extending between the two major surfaces of sheet 16; or the openings 34 can be in the form of blind holes 34*b* extending from one major surface (FIG. 7B) or in the form of blind holes 34*c* extending from both major surfaces (FIG. 7C). The openings of FIGS. 4–6 may be arranged in a similar fashion as those of FIG. 3 and are not separately illustrated.

As mentioned above, the dielectric sheet 16 may be made of a ceramics, such as LTCC, having a dielectric constant of approximately 6. LTCC can be machined into the desired shape and with the desired hole pattern by drilling and/or milling. LTCC can also be coated with metals.

Figure 8A:
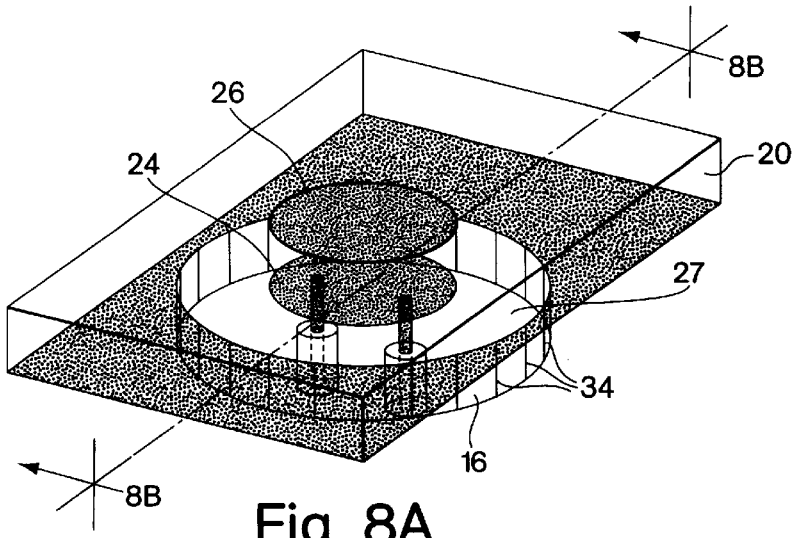
FIGS. 8A–8C show a sixth embodiment of the patch radiator array according to the invention.
Figure 8B:
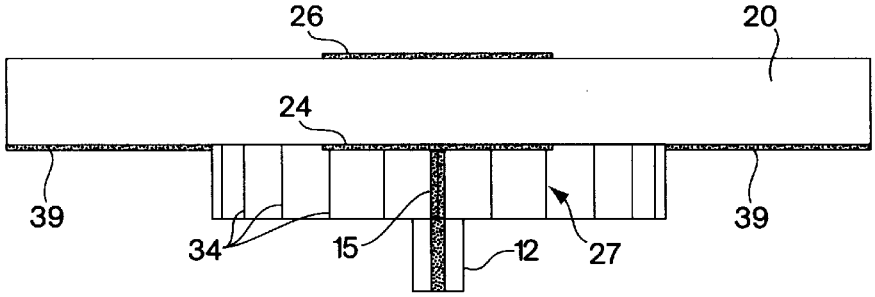
Figure 8C:
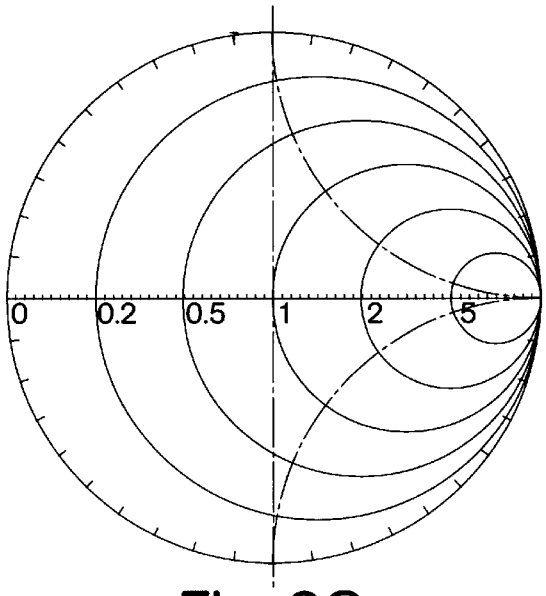
Figure 9A:
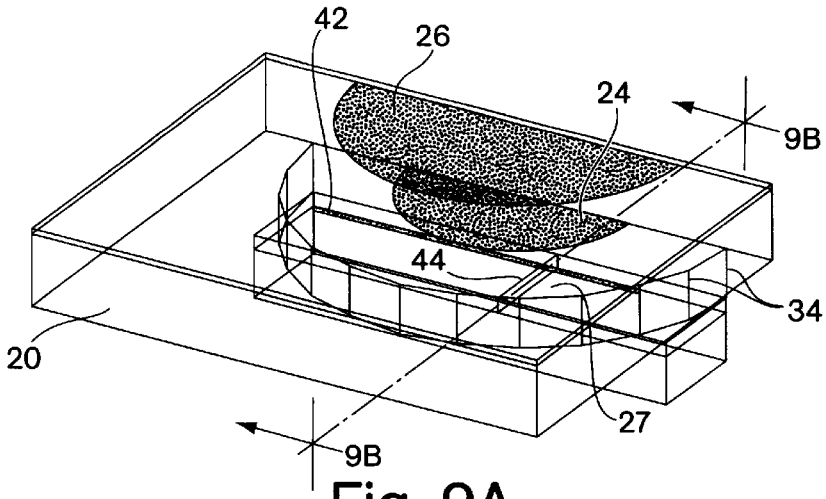
FIGS. 9A–9C show a seventh embodiment of the patch radiator array according to the invention.
Figure 9B:
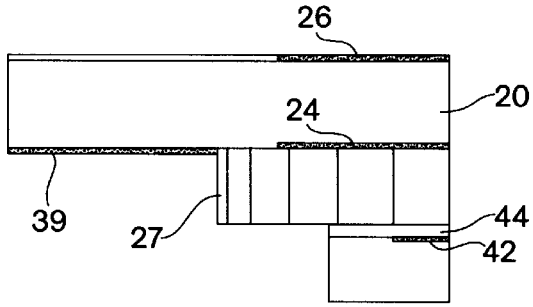

Referring now to FIGS. 8 and 9, in another embodiment of the invention, patch radiator elements 24, 26 are of substantially circular shape and disposed directly onto the second dielectric sheet 20. Alternatively, first patch radiator elements 24 may be disposed on first dielectric sheet 16, of which for sake of clarity only the regions 27 are shown. Depositing the patch electrodes 24, 26 directly on a respective dielectric sheet 16, 20 eliminates the respective separate supports 18, 22 of FIG. 1. Furthermore, as indicated in FIGS. 8B and 9B, at least a portion of a respective major surface 39, 39' of one or both of the dielectric sheets 16, 20 coplanar with the patch radiator elements 24 may be metallized to provide a ground connection, thereby eliminating the separate ground plane 14 of FIG. 1.

As in the embodiment of FIGS. 3–6, holes or slots 34 arranged in first dielectric sheet 16 provide a dielectric discontinuity in sheet 16 to define regions 27.

FIG. 8A is a perspective view and FIG. 8B a cross-sectional view taken along the line VIB—VIB of FIG. 8A of a single patch radiator element, with RF signal power supplied by two coaxial supply lines 12. To form the array antenna, the elements can the arrayed, e.g., in a rectangular or—for closer spacing between elements—a close-packed pattern. The phases between the two lines 12 are shifted relative to each other by 180°, providing polarized RF emission, with the direction of the H-polarization perpendicular to the line connecting the two feed lines 12. Circularly polarized RF emission can be produced, for example, by employing four RF feed lines, with the RF signals 90° phase-shifted relative to each other.

FIG. 8C represents a plot of the Voltage-Standing-Wave Ratio (VSWR) for a periodic antenna array employing the patch radiator elements of FIGS. 6A and 6B. The VSWR is defined as $VSWR=(1+\rho)/(1-\rho)$ wherein $\rho$ is the reflection coefficient of the received (or supplied) RF signal. An ideal lossless antenna would have a VSWR of 1. The exemplary antenna array operates in the K-band (18–27 GHz) and has a VSWR of less than 1.2 at ±30° of scan in the H-plane.

Figure 9C:
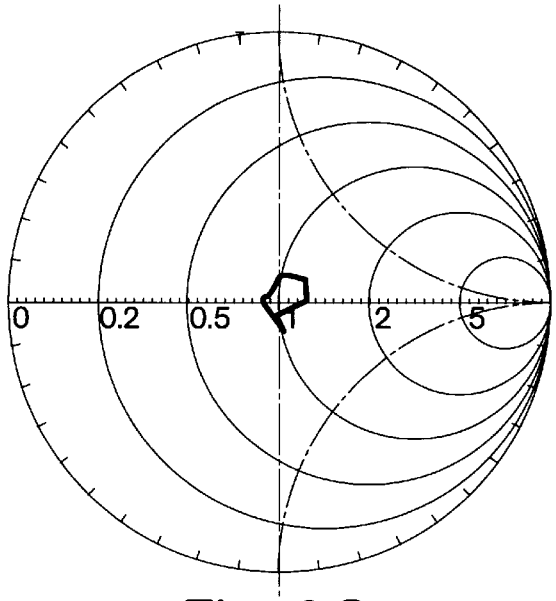

Referring now to FIGS. 9A–9C, RF signal power is fed to the patch radiator element 24 via a strip line waveguide 42. Only one half of the exemplary patch radiator element is shown; the second half is the mirror image of the first half. The RF power from strip line 42 is coupled to the lower patch 24 via aperture 44. As in FIG. 8A, openings 34 are provided to isolate regions 27.

FIG. 9C represents a plot of the VSWR for the periodic antenna array employing the patch radiator elements of FIGS. 9A and 9B. The exemplary antenna array operates in the X-band (8–12 GHz) and has a VSWR of less than 1.2 at ±30° of scan in the H-plane.

Referring now to FIG. 10, the maximum scan angles attainable with a patch radiator array having the patch radiator elements illustrated in FIGS. 8A–C is compared with the maximum scan angles of a conventional patch radiator array having continuous dielectric sheets 16 and 20. The results listed in FIG. 10 are obtained with respective arrays having the elements arranged on a square lattice with a center-to-center spacing of $\lambda/2$, wherein $\lambda$ is the design wavelength of the array. The dielectric layers 16 and 20 have an identical thickness of 0.075 $\lambda$. In the present example, the dielectric constant of layer 20 is 1.3.

The listed values of the maximum scan angle represent the boundary conditions for "scan blindness"; practical limits will, of course, depend on the signal-to-noise ratio of a receiver and/or the signal power of a transmitter coupled to the array. As seen in FIG. 10, the scan angle attained with the inventive patch elements is 83.7° independent of the dielectric constant of layer 16. Conversely, the maximum scan angle of a conventional patch element array with a continuous dielectric sheet 16 drops precipitously when the dielectric constant of layer 16 increases. For example, when the dielectric layer 16 is made of LTCC ($\in_{16}\approx 6$), the maximum scan angle of the array according to the invention is more than twice that of a conventional array, corresponding to a more than fourfold increase in the maximum scan volume attainable in three dimensions.

While the invention has been disclosed in connection with the preferred embodiments shown and described in detail, various modifications and improvements thereon will become readily apparent to those skilled in the art. For example, instead of providing the discontinuities in the dielectric constant between adjacent patch antenna elements, such discontinuities may be provided only between every other element or at an even greater spacing. Accordingly, the spirit and scope of the present invention is to be limited only by the following claims.

We claim:

1. A patch radiator antenna array comprising:

a single continuous conductive ground plane element having a major surface;

a first continuous dielectric planar member disposed over the major surface of the ground plane element and having embedded therein isolated electrically conductive regions;

a plurality of feed patch radiator elements disposed on a face of the first dielectric member remote from the ground plane element, each feed patch radiator element defining a respective feed patch area and adapted to be coupled to at least one of an RF signal source and an RF receiver, with the isolated electrically conductive regions being disposed around a respective feed patch area so as to completely surround the feed patch area;

a second continuous dielectric planar member disposed over the plurality of feed patch radiator elements;

a plurality of coupled patch radiator elements disposed on the second dielectric member remote from the feed patch radiator elements, each coupled patch radiator element associated with a corresponding feed patch radiator element, wherein the first dielectric planar member has a first dielectric constant that is greater than a second dielectric constant of the second dielectric planar member.

2. The patch radiator antenna array of claim 1, wherein the isolated electrically conductive regions comprise a plurality of spaced apart openings arranged substantially in respective regions located between adjacent patch areas.

3. The patch radiator antenna array of claim 2, wherein each opening extends partially from at least one of the first and second surfaces of the first dielectric planar member towards the opposite second and first surface.

4. The patch radiator antenna array of claim 2, wherein the at least one opening is a round hole.

5. The patch radiator antenna array of claim 2, wherein at least one of the openings is a slot.

6. The patch radiator antenna array of claim 2, wherein at least one of the openings has an inside surface which is metallized.

7. The patch radiator antenna array of claim 2, wherein at least one of the openings is filled with a material having a dielectric constant with a value that is different from that of the material surrounding the opening.

8. The patch radiator antenna array of claim 7, wherein at least one of the openings is filled with a metal.

9. The patch radiator antenna array of claim 1, wherein the feed patch radiator elements are disposed on a support sheet which is separate from the first and second dielectric planar members.

10. The patch radiator antenna array of claim 1, wherein the coupled patch radiator elements are arranged on a second support sheet that is separate from the second dielectric planar member.

11. The patch radiator antenna array of claim 1, wherein feed and coupled patch radiator elements are spaced from respective adjacent feed and coupled patch radiator element by approximately $\lambda/2$, wherein $\lambda$ is a free space wavelength radiated by the patch radiator antenna array.

12. The patch radiator antenna array of claim 1, wherein the value of the first dielectric constant is between approximately 1.5 and 8.

13. The patch radiator antenna array of claim 1, wherein the first dielectric planar member comprises Low-Temperature Co-fired Ceramics (LTCC).

14. The patch radiator antenna array of claim 1, wherein the second dielectric constant is between approximately 1.0 and 2.5.

* * * * *